US005492200A

United States Patent [19]

Korhonen

[11] Patent Number: 5,492,200

[45] Date of Patent: Feb. 20, 1996

[54] PROCEDURE AND APPARATUS FOR TRIGGERING THE SAFETY GEAR OF AN ELEVATOR

[75] Inventor: Helge Korhonen, Oitti, Finland

[73] Assignee: Kone Oy, Helsinki, Finland

[21] Appl. No.: 249,255

[22] Filed: May 25, 1994

[30] Foreign Application Priority Data

Jun. 8, 1993 [FI] Finland ..... 932607

[51] Int. Cl.[6] ..... B66B 5/00

[52] U.S. Cl. ..... 187/350; 188/189

[58] Field of Search ..... 187/350, 373, 187/374, 376; 188/189, 188

[56] References Cited

U.S. PATENT DOCUMENTS

| | | | |
|---|---|---|---|
| 3,327,811 | 6/1967 | Mastroberte | 187/350 |
| 4,653,612 | 3/1987 | Winkler | 187/38 |
| 5,183,978 | 2/1993 | Sheridan et al. | 187/105 |

FOREIGN PATENT DOCUMENTS

| | | |
|---|---|---|
| 121711 | 10/1984 | European Pat. Off. . |
| 0121711 | 10/1984 | European Pat. Off. . |
| 76049 | 5/1988 | Finland . |
| 1236153 | 2/1961 | Germany . |
| 2151810 | 7/1985 | United Kingdom . |

*Primary Examiner*—Kenneth Noland
*Attorney, Agent, or Firm*—Birch, Stewart, Kolasch & Birch

[57] ABSTRACT

A procedure and an apparatus triggers the safety gear of an elevator at a speed lower than the gripping speed. The overspeed governor of the elevator comprises a pulley (3) driven by the safety gear rope and a brake (5) connected to it by knuckle pins (14,14'). The brake is provided with centrifugal weights (16,16'). Eccentric cams (15,15') and a brake disc (6) are also provided for the overspeed governor. At a speed lower than the gripping speed, using a separately controlled solenoid (30) attached to the overspeed governor, the brake (5) is caused to engage the pulley (3) by driving the plunger of the solenoid into the path of rubber rollers (31,32) rotating with the centrifugal weights.

19 Claims, 2 Drawing Sheets

PROCEDURE AND APPARATUS FOR TRIGGERING THE SAFETY GEAR OF AN ELEVATOR

FIELD OF THE INVENTION

The present invention relates to a procedure and an apparatus for triggering the safety gear of an elevator at a speed lower than the gripping speed in an elevator in which the triggering of the safety gear in an overspeed situation is effected by means of a rope driving an overspeed governor via a rope pulley in such a manner that when the orbit of the centrifugal weights in the overspeed governor assumes a width exceeding the orbit corresponding to the set gripping speed, this will cause the brake comprised in the overspeed governor to engage the rope pulley.

DESCRIPTION OF THE BACKGROUND ART

Conventionally, elevators are equipped with a safety gear which is triggered by an overspeed governor. A common solution is such that when the elevator speed in the overspeed governor reaches a preset limit, the overspeed governor triggers the safety gear by means of the same rope that transmits the elevator speed to the overspeed governor. The structure and operation of an overspeed governor of this type is described in Finnish patent publication no. 76049.

In addition to gripping in an overspeed situation, situations occur in which the safety gear ought to be activated even if the elevator speed does not exceed the allowed limit. These situations include the testing of the safety gear in connection with the inspection of the elevator. For instance, certain elevators using a geared hoisting machinery cannot usually be accelerated to the gripping speed, requiring exceptional measures to allow the gripping function to be checked. Failure situations may also occur where it should be possible to stop the elevator independently of the hoisting machinery and the operating brake. A failure situation of this type is e.g. when an elevator starts from a floor with doors completely or partially open.

Another problem at present is that the overspeed governor has to be placed in a 10action where it can be accessed during inspection. If the elevator has a machine room, this is no problem, but in the case of other solutions regarding the machinery, when the overspeed governor is placed in the elevator shaft, a separate manhole is needed to permit the overspeed governor to be locked by way of exception in connection with inspection.

SUMMARY OF THE INVENTION

To meet the need described above and to solve the problems referred to, a procedure and an apparatus are presented as an invention. The procedure of the invention and the apparatus of the invention use a brake which is caused to engage the rope pulley regardless of the rotation speed of the eccentric weights. This engagement is done by means of an obstruction device attached to the overspeed governor and provided with separate control means.

The advantages achieved by the invention include the following:

The invention enables the gripping action to be triggered at a speed lower than the gripping speed, thus facilitating the testing of the operation of the safety gear.

The invention allows the elevator to be stopped in dangerous situations below the gripping speed, e.g. when the elevator starts from a floor with the doors open.

The invention can be used to prevent the car from creeping downwards from the landing during stoppage, so the invention makes it possible to use the gripping function to replace the anti-creep device in hydraulic elevators.

The invention can be implemented in a simple way and does not require any big changes in the basic structure of the overspeed governor.

The invention is applicable for an overspeed governor which is locked in the triggering position and is only released from the locked skate when it is rotated in the reverse direction; in other words, with the apparatus of the invention, the overspeed governor or its triggering system need not be separately reset but is reset at the same time when the elevator is released from the gripping state.

The solution of the invention tolerates ordinary variations in dimensions occurring in manufacture and does not require any extraordinary precision in installation or maintenance.

The overspeed governor of the invention can be triggered by remote control and this allows it to be be mounted in the elevator shaft, at its top or bottom without the need for a separate manhole.

In the following, the invention is described in detail by the aid of one of its embodiments, without limiting the invention itself. In this application example, the invention is described as used in connection with an overspeed governor as presented in Finnish patent specification n. 79049.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Reference is made to the following drawings which are given by way of illustration only, and thus are not limitative of the present invention, and in which.

DETAILED DESCRIPTION OF THE PREFERRED EMBODIMENTS

Figure 1:
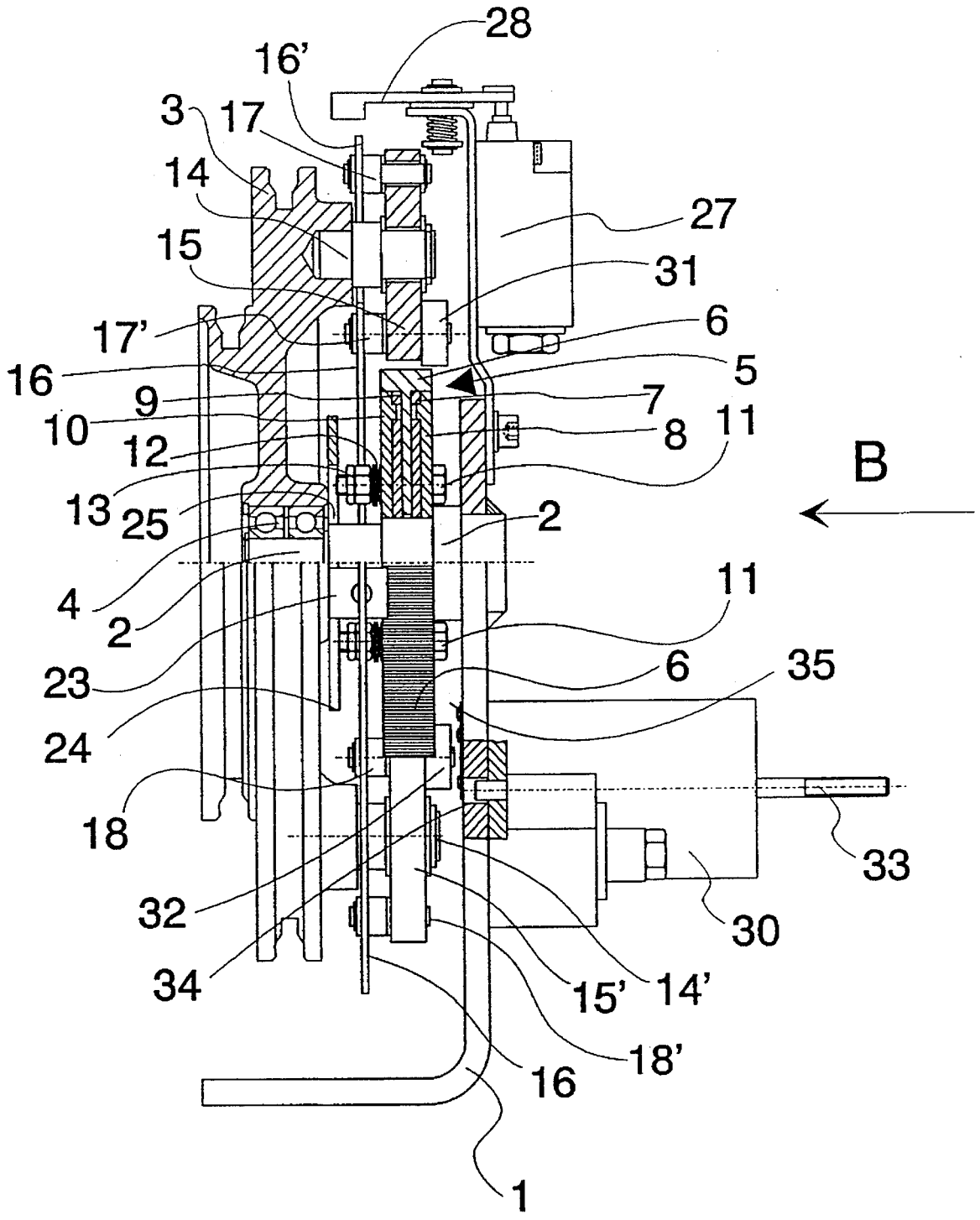
FIG. 1 presents an overspeed governor in which the invention is applied, in side view and partially sectioned along line A—A in FIG. 2.
Figure 2:
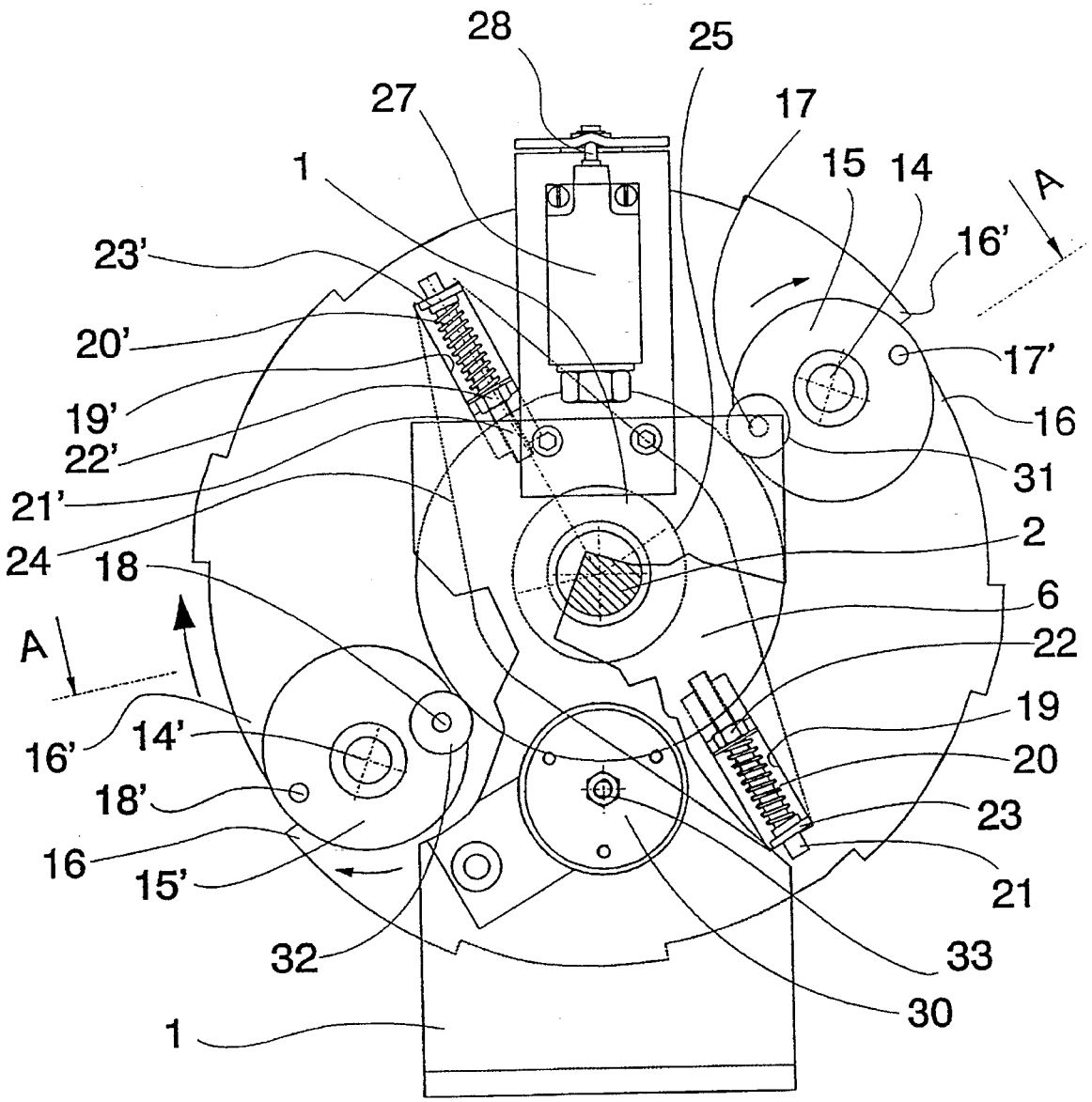
FIG. 2 presents the overspeed governor as seen from direction B in FIG. 1.

Welded onto a support 1, which in FIG. 2 is partially sectioned, is a shaft 2 on which a rope pulley 3 has been rotatably mounted by means of ball bearings 4. Mounted beside the rope pulley 3 on the shaft 2 is a brake 5 consisting of a brake disc 6 rotatable with respect to the shaft 2, a front plate 8 joined with the shaft 2 by welding and pressed against the brake disc via brake clutches 7 and a back plate 10 similarly pressed against the brake disc 6 via brake clutches 9. Welded onto the front plate 8 are key bolts 11 going through the front plate 8 and back plate 10 and carrying disk springs 12 which are pretensioned by means of an adjusting nut 13 screwed onto the key bolt 11. The adjusting nuts 13 are used to adjust the braking force applied by the plates 8 and 10 to the brake disc 6. The overspeed governor described as an example can be regarded as a device mainly rotating on the shaft 2 or as a device whose main parts are fitted to rotate about the shaft 2.

The rope pulley 3 supports two knuckle pins 14,14' placed diametrically opposite to each other on the side of the pulley facing towards the brake 5. Rotatably mounted on the knuckle pins 14,14' are two eccentric cams 15,15' placed above the brake disc 6 (i.e. outside the diameter of the brake disc) and acting as coupling elements. The eccentric cams are connected by two curved centrifugal weights 16,16' essentially symmetrical in shape. As seen from the direction of the shaft 2, the centrifugal weights together form a body resembling a split circular plate with a large opening in the middle for the shaft 2 and other parts. One end of each centrifugal weight 16,16' is turnably mounted on an eccentric bolt 17,17' on the first eccentric cam 15 and the other end on an eccentric bolt 18,18' on the second eccentric cam 15'. In the mass center area of each centrifugal weight 16,16' is an opening 19,19' in which is placed a spring pin 21,21' carrying a counter spring 20,20' formed as a pressure spring. Screwed onto the spring pin 21,21' is an adjusting nut 22,22' protected with a stop plate against thread breakage. One end of the pressure spring 20,20' is retained by the adjusting nut 22,22' while the other end is retained by a lug 23,23' protruding from a spring holder 24. The two lugs 23,23' are placed at opposite ends of the spring holder 24. The spring holder 24 is held in place by the spring pins 21,21' and the pressure springs 20,20' . The spring holder 24 is provided with a clearance 25 for the shaft 2 in the middle, permitting the spring holder to rotate with the centrifugal weights 16,16' without coming into contact with the shaft 2. The eccentric cams 15,15' are provided with protursions 31,32 mounted on their inner eccentric bolts 17,18. The protrusions 31,32 are preferably rubber rollers. Attached to the support 1 is a solenoid 30 acting as an obstruction device and so mounted that its plunger 33 can pass through an opening 34 provided in the support. The location of the opening 34 determines the placement of the solenoid 30 and its plunger 33. The opening 34, solenoid 30 and its plunger 33 are placed at a distance from the shaft 2 of the overspeed governor such that, when the plunger 33 is thrust into the space 35 between the support 1 and the rotating parts of the overspeed governor, the plunger 33 will come into the path of the rubber rollers 31,32 at least when the elevator speed is below the gripping speed. Preferably the rubber rollers 31,32 are so placed in space 35 and correspondingly the maximum range of movement of the plunger 33 into space 35 is such that, when the plunger 33 is thrust into space 35, it can only reach the rubber rollers 31,32. In FIG. 2, the direction of rotation of the overspeed governor corresponding to the direction of elevator travel during gripping and the direction of rotation of the eccentric cams 15,15' corresponding to the acceleration of the elevator are indicated with arrows placed at the outer circles of the overspeed governor and eccentric cams 15,15'.

In an overspeed situation, the overspeed governor functions as follows. Placed on the outer edge of the centrifugal weights 16,16' are tripping cams interacting with a switch 27 mounted on the support. The switching arm 28 of the switch is placed outside the diameter of the orbit of the centrifugal weights. When a certain speed of rotation is exceeded, the switch 27 will disconnect the operating power as soon as the centrifugal weights 16,16' spread and cause the switching arm 28 to be turned by the tripping cams. This rotational speed is lower than the triggering speed of the the gripping action. When the set triggering speed is exceeded, the eccentric cams 15,15' are turned by the centrifugal weights 16,16' so as to cause their eccentric rim to engage the rim of the brake disc 6, whereupon the brake 5 will brake the rope pulley 3 via the eccentric cams 15,15' Via the rope pulley 3, also the rope driving it is braked and thus the safety gear of the elevator is triggered.

To enable the overspeed governor to be triggered into action by a cause other than the centrifugal force, forced triggering can be implemeted by using remote control, in which case the following will occur: The plunger 33 of the solenoid 30 is thrust into space 35, which is a gap between the support 1 and the rotating parts, in the first place the eccentric cams 15,15', of the overspeed governor. As the elevator is moving, i.e. the overspeed governor is rotating, one of the eccentric cams 15,15' will reach the plunger and the rubber roller (protrusion) 31,32 on the eccentric cam will hit the plunger 33. Since the rubber rollers 31,32 are attached to the eccentric cams 15,15', which are turnably mounted on the knuckle pins 14,14' and centrifugal weights 16,16', the force resulting from the collision between the rubber roller and the plunger advanced into its path (i.e. the supporting force applied by the plunger to the roller) pushes the rubber roller so that the latter will give way to the plunger 33. This yielding motion of the roller turns the eccentric cam into a position where the eccentric cam meets the brake disc 6. As the eccentric cam turns, it also moves the centrifugal weights outwards into an orbit corresponding to the gripping speed and indirectly turns the opposite eccentric cam so that it meets the brake disc 6.

In this way, the gripping function is triggered and the switch 27 activated by the combined effect of the plunger 33 being thrust into space 35 and the rotation of the overspeed governor, i.e. movement of the elevator. This overspeed governor is designed to trigger the safetey gear during downward travel only, so the solenoid is only allowed to thrust out its plunger during this condition. If the solenoid of this overspeed governor is to be so constructed that its plunger is thrust e.g. by a spring into space 35 when the solenoid receives no current, then it will be necessary to provide e.g. the plunger with a protection so that if the roller does not give way to the plunger, then the plunger will have to yield at the impact. The protection could be implemeted e.g. by using a plunger with a collapsible end that would yield upon impact against a roller. To achieve a more effective engagement between the eccentric cams 15,15' and the brake disc 6, their rims can be roughened or jagged or provided with a coating. The area of engagement of the eccentric cams 15,15' can be limited e.g. by means of a bolt placed at the edge of the cams 15,15'.

The structures of the apparatus need not be made especially strong because of the impact resulting from remote triggering because the impact is damped. Elastic impact ensures a reliable engagement between the protrusion 31,32 and the plunger 33 as it is unlikely to produce a recoil which might result from a hard impact and which could throw back the rotating part too soon from the position where the brake is to be engaged.

It is obvious to a person skilled in the art that different embodiments of the invention are not restricted to the examples described above, but that they may instead be varied within the scope of the claims presented below. For instance, instead of rubber rollers it is possible to use some other elastic material and/or structure. It is obvious that instead of placing the rubber roller as in the solution presented as an example, the roller could be placed on the plunger of the solenoid, in which case the protrusions engaged by it would be hard, and that both the plunger and the protrusions could be elastic.

It is further obvious to the skilled person that the invention could be implemented using a solution in which the plunger or an equivalent control means is thrust e.g. manually to a position where it engages the eccentric cams so as to turn them.

It is also obvious to the skilled person that in applying the invention is is possible to provide the overspeed governor with several solenoids, or to use one solenoid to move several plungers or similar obstructions which are thrust into the path of the rubber rollers at speeds below the gripping speed. For instance, by using three obstructions spaced at 60° or 120° instead of one plunger as described in the example, the maximum angular interval preceding gripping could be reduced from 180° to 60°, which means in the case of an overspeed governor with a 200-mm rope pulley that the gripping action would be triggered by a movement of 11 cm, which would enable the overspeed governor to be used to implement the function of an anti-creep device. It is further obvious that it depends on the practical application whether the plunger is to be thrust out upon switch-on of power to the solenoid or upon interruption of the supply of power.

I claim:

1. A method for triggering a safety gear at a speed lower than a gripping speed in an elevator in which the triggering of the safety gear in an overspeed situation is effected by a rope driving an overspeed governor via a rope pulley in such a manner that centrifugal weights in the overspeed governor assume an orbit outside an orbit corresponding to a set gripping speed when in the overspeed situation, coupling elements moving a brake of the overspeed governor to frictionally engage the rope pulley when the centrifugal weights move to the orbit outside the set gripping speed orbit, the safety gear of the elevator being triggered when the brake engages the rope pulley to brake the rope driving the pulley, the method for triggering the safety gear at a speed lower than the overspeed comprising the steps of:

providing an obstruction device adjacent the brake, the obstruction device having an obstruction;

moving the obstruction into engagement with a portion of the coupling elements to thereby activate the brake regardless of the speed of the elevator, the portion of the coupling elements engaged by the obstruction or the obstruction being elastic;

dampening impact between the coupling elements and the obstruction due to use of elastic.

2. The method according to claim 1, wherein the rope pulley is rotatable about a shaft and wherein the coupling elements are mounted on the rope pulley and rotatable therewith, the method further comprising the step of deflecting the portion of the coupling elements engaged by the obstruction away from the shaft.

3. The method according to claims 2, wherein the portion of coupling elements which is engaged by the obstruction is an elastic protrusion.

4. The method according to claim 1, wherein the rope pulley is rotatable about a shaft and wherein the coupling elements are mounted on the rope pulley and rotatable therewith, the method further comprising the steps of:

deflecting at least one of the coupling elements to move away from the shaft when the obstruction is moved into engagement with the portion of the coupling elements; and activating a switch to turn off operating current to the elevator when the at least one of the coupling elements is deflected, the switch being engaged by one of the coupling elements when being activated.

5. The method according to claim 1, wherein the coupling elements comprise a plurality of protrusions for engagement with the obstruction and a plurality of eccentric cams, the protrusions being mounted on the eccentric cams, the eccentric cams being mounted between the centrifugal weights and being movable into engagement with the brake when the centrifugal weights assume the orbit outside the set gripping speed orbit when in the overspeed situation, the method further comprising the step of moving the eccentric cams into engagement with the brake when the obstruction engages one of the protrusions.

6. The method according to claim 5, further comprising the step of using elastic rollers as the protrusions.

7. The method according to claim 1, further comprising the step of using an elastic obstruction.

8. A method for triggering a safety gear at a speed lower than a gripping speed in an elevator in which the triggering of the safety gear in an overspeed situation is effected by a rope driving an overspeed governor via a rope pulley in such a manner that centrifugal weights in the overspeed governor assume an orbit outside an orbit corresponding to a set gripping speed when in the overspeed situation, coupling elements moving a brake of the overspeed governor to frictionally engage the rope pulley when the centrifugal weights move to the orbit outside the set gripping speed orbit, the safety gear of the elevator being triggered when the brake engages the rope pulley to brake the rope driving the pulley, the rope pulley being rotatable about a shaft and the coupling elements being mounted on the rope pulley and being rotatable therewith, the method for triggering the safety gear at a speed lower than the overspeed comprising the steps of:

providing an obstruction device adjacent the brake, the obstruction device having an obstruction;

moving the obstruction into engagement with a portion of the coupling elements to thereby activate the brake regardless of the speed of the elevator;

deflecting at least one of the coupling elements to move away from the shaft when the obstruction is moved into engagement with the portion of the coupling elements; and activating a switch to turn off operating current to the elevator when the at least one of the coupling elements is deflected, the switch being engaged by one of the coupling elements when being activated.

9. The method according to claim 8, wherein the coupling elements comprise a plurality of protrusions, a plurality of eccentric cams, and the centrifugal weights, the protrusions being engageable with the obstruction and being mounted on the eccentric cams, the eccentric cams being mounted between the centrifugal weights and being movable into engagement with the brake when the centrifugal weights assume the orbit outside the set gripping speed orbit when in the overspeed situation, the method further comprising the step of moving the eccentric cams into engagement with the brake when the obstruction engages one of the protrusions.

10. The method according to claim 9, wherein one of the centrifugal weights engages the switch when the obstruction engages one of the protrusions.

11. An apparatus for triggering a safety gear at a speed lower than a gripping speed in an elevator in which the triggering of the safety gear in an overspeed situation is effected by a rope driving an overspeed governor via a rope pulley in such a manner that centrifugal weights in the overspeed governor assume an orbit outside an orbit corresponding to a set gripping speed when in the overspeed situation, coupling elements moving a brake of the overspeed governor to frictionally engage the rope pulley when the centrifugal weights move to the orbit outside the set gripping speed orbit, the safety gear of the elevator being triggered when the brake engages the rope pulley to brake the rope driving the pulley, the apparatus for triggering the safety gear at a speed lower than the overspeed comprising an obstruction device with an obstruction movable into engagement with a portion of the coupling elements to thereby activate the brake regardless of the speed of the elevator, the portion of the coupling elements engaged by the obstruction or the obstruction being elastic to dampen impact between the coupling elements and the obstruction.

12. The apparatus according to claim 11, wherein the rope pulley is rotatable about a shaft and wherein the coupling elements are mounted on the rope pulley and rotatable therewith, at least one of the coupling elements being moveable away from the shaft when the obstruction is moved into engagement with the portion of the coupling elements.

13. The apparatus according to claim 12, wherein the portion of the coupling elements which is engaged by the obstruction is an elastic protrusion.

14. The apparatus according to claim 12, further comprising a switch adjacent the brake for turning off operating current to the elevator when the at least one of the coupling elements is deflected, the switch being engaged by one of the coupling elements when being activated.

15. The apparatus according to claim 11, wherein the obstruction device comprises a solenoid and wherein the obstruction comprises a plunger of the solenoid.

16. The apparatus according to claim 11, wherein the obstruction is elastic.

17. The apparatus according to claim 11, wherein the portion of the coupling elements which is engaged by the obstruction is elastic.

18. The apparatus according to claim 11, wherein the coupling elements comprise a plurality of protrusions for engagement with the obstruction and a plurality of eccentric cams, the protrusions being mounted on the eccentric cams, the eccentric cams being mounted between the centrifugal weights and being movable into engagement with the brake when the centrifugal weights assume the orbit outside the set gripping speed orbit when in the overspeed situation, the eccentric cams further being movable into engagement with the brake when the obstruction engages one of the protrusions.

19. The apparatus according to claim 18, wherein the protrusions are elastic rollers.

* * * * *